US008006835B2

(12) United States Patent
Moore et al.

(10) Patent No.: US 8,006,835 B2
(45) Date of Patent: Aug. 30, 2011

(54) BLANK FOR FORMING SLEEVE INCLUDING A POCKET

(75) Inventors: Pamela D. Moore, Gloucester, VA (US); Stephen J. Bellamah, Midlothian, VA (US); Dominic J. C. Howard, New Canaan, CT (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/332,776

(22) Filed: Dec. 11, 2008

(65) Prior Publication Data

US 2009/0250361 A1 Oct. 8, 2009

Related U.S. Application Data

(60) Provisional application No. 60/996,965, filed on Dec. 12, 2007.

(51) Int. Cl.
*A24F 15/00* (2006.01)
*B65D 85/10* (2006.01)
*B65D 85/12* (2006.01)

(52) U.S. Cl. ..... 206/273; 206/45.21; 206/45.25

(58) Field of Classification Search ..... 206/273, 206/784, 45.21, 45.22, 45.25, 175
See application file for complete search history.

(56) References Cited

U.S. PATENT DOCUMENTS

| | | | |
|---|---|---|---|
| 1,906,742 | A | 5/1933 | Coulapides |
| 2,011,399 | A | 8/1935 | Driscoll |
| 2,494,724 | A | 1/1950 | Schmidt |
| 3,039,671 | A | 6/1962 | Chiamardas |
| 3,241,738 | A | 3/1966 | Freiman |
| 3,563,449 | A | 2/1971 | Forbes, Jr. et al. |
| 3,901,386 | A | 8/1975 | Hennessey |
| 4,003,467 | A | 1/1977 | Focket et al. |
| D261,110 | S | 10/1981 | Yoshimoto |
| D266,224 | S | 9/1982 | Bronander, Jr. |
| D273,426 | S | 4/1984 | Zucker |
| D309,570 | S | 7/1990 | Kinoshita |
| D319,587 | S | 9/1991 | Lee |
| D344,018 | S | 2/1994 | Kelsey et al. |
| 5,366,077 | A | 11/1994 | Pham |

(Continued)

FOREIGN PATENT DOCUMENTS

DE 29708543 U1 7/1997

(Continued)

OTHER PUBLICATIONS

International Search Report and Written Opinion mailed May 8, 2009.

(Continued)

*Primary Examiner* — Mickey Yu
*Assistant Examiner* — Rafael Ortiz
(74) *Attorney, Agent, or Firm* — Buchanan Ingersoll & Rooney PC

(57) ABSTRACT

An elongate blank for forming a sleeve includes a plurality of panels. The panels include two rear panels. When the blank is folded to form the sleeve, an outer rear panel overlies an inner rear panel and a pocket is formed between these panels. The pocket is configured to contain one or more objects. The sleeve is adapted to be placed on a container, such as a package containing smoking articles. The pocket can contain another tobacco product, such as one or more promotional smokeless tobacco products.

28 Claims, 6 Drawing Sheets

U.S. PATENT DOCUMENTS

| | | | | |
|---|---|---|---|---|
| D353,091 | S | 12/1994 | Mumford | |
| D370,301 | S | 5/1996 | Murphy | |
| 5,513,752 | A * | 5/1996 | Gottlieb | 206/387.1 |
| D395,235 | S | 6/1998 | Andersson | |
| D401,853 | S | 12/1998 | Stavridis | |
| D423,931 | S | 5/2000 | Davis | |
| 6,467,614 | B1 | 10/2002 | Tallier et al. | |
| D465,416 | S | 11/2002 | Dzwill et al. | |
| 6,510,943 | B2 * | 1/2003 | Okin et al. | 206/216 |
| D470,411 | S | 2/2003 | Menceles | |
| D496,135 | S | 9/2004 | Hillock | |
| 6,837,369 | B2 | 1/2005 | Amos | |
| 6,932,219 | B2 | 8/2005 | Chacko et al. | |
| D537,561 | S | 2/2007 | Counts et al. | |
| 7,331,451 | B2 | 2/2008 | Focke et al. | |
| D575,452 | S | 8/2008 | Jones et al. | |
| D580,751 | S | 11/2008 | Blick | |
| 2002/0117409 | A1 | 8/2002 | Okin et al. | |
| 2003/0034255 | A1 * | 2/2003 | Luton et al. | 206/268 |
| 2003/0121805 | A1 | 7/2003 | Chacko et al. | |
| 2004/0222110 | A1 | 11/2004 | Holmon | |
| 2005/0000841 | A1 * | 1/2005 | DuBois et al. | 206/438 |
| 2006/0054518 | A1 * | 3/2006 | Focke et al. | 206/273 |
| 2008/0093233 | A1 | 4/2008 | Jones et al. | |
| 2008/0164161 | A1 | 7/2008 | Tosaka et al. | |

FOREIGN PATENT DOCUMENTS

| | | | |
|---|---|---|---|
| DE | 29901874 | U1 | 4/1999 |

OTHER PUBLICATIONS

International Preliminary Report on Patentability for PCT/IS2008/003679 mailed on Jun. 15, 2010.

* cited by examiner

FIG. 2
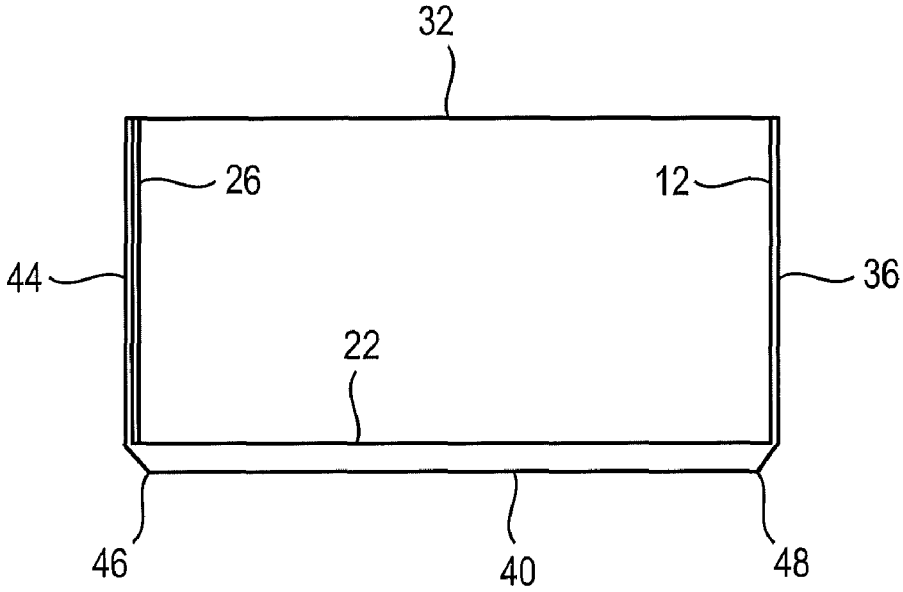
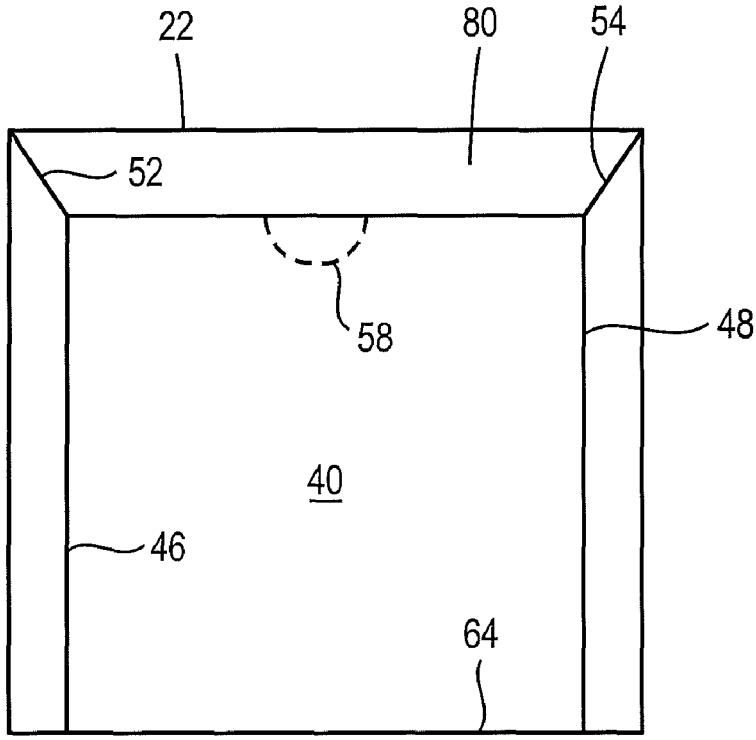
FIG. 3

BLANK FOR FORMING SLEEVE INCLUDING A POCKET

CROSS-REFERENCE TO RELATED APPLICATION

This application claims benefit of the filing date of U.S. Provisional Application Ser. No. 60/996,965 filed Dec. 12, 2007, the entire content of which is incorporated herein by reference.

BACKGROUND

Cigarettes are sold in packages while tobacco products, such as chewing tobacco, are provided in different forms of packaging.

SUMMARY

An embodiment of an elongate blank for forming a sleeve for a container comprises an inner right side panel; an inner rear panel connected to the inner right side panel along a first vertical fold line; an inner left side panel connected to the inner rear panel by a second vertical fold line; a front panel connected to the inner left side panel by a third vertical fold line; an outer right side panel connected to the front panel by a fourth vertical fold line; an outer rear panel connected to the outer right side panel by a fifth vertical fold line; and an outer left side panel connected to the outer rear panel by a sixth vertical fold line; wherein the elongate blank is foldable to form a sleeve opening between the inner right side panel, the inner rear panel, the inner left side panel and the front panel and a pocket between the inner rear panel and the outer rear panel.

BRIEF DESCRIPTION OF THE DRAWINGS

FIG. 2 is a top view of a sleeve formed by folding the blank shown in FIG. 1.

FIG. 3 is a rear view of the formed sleeve.

DETAILED DESCRIPTION

Figure 1:
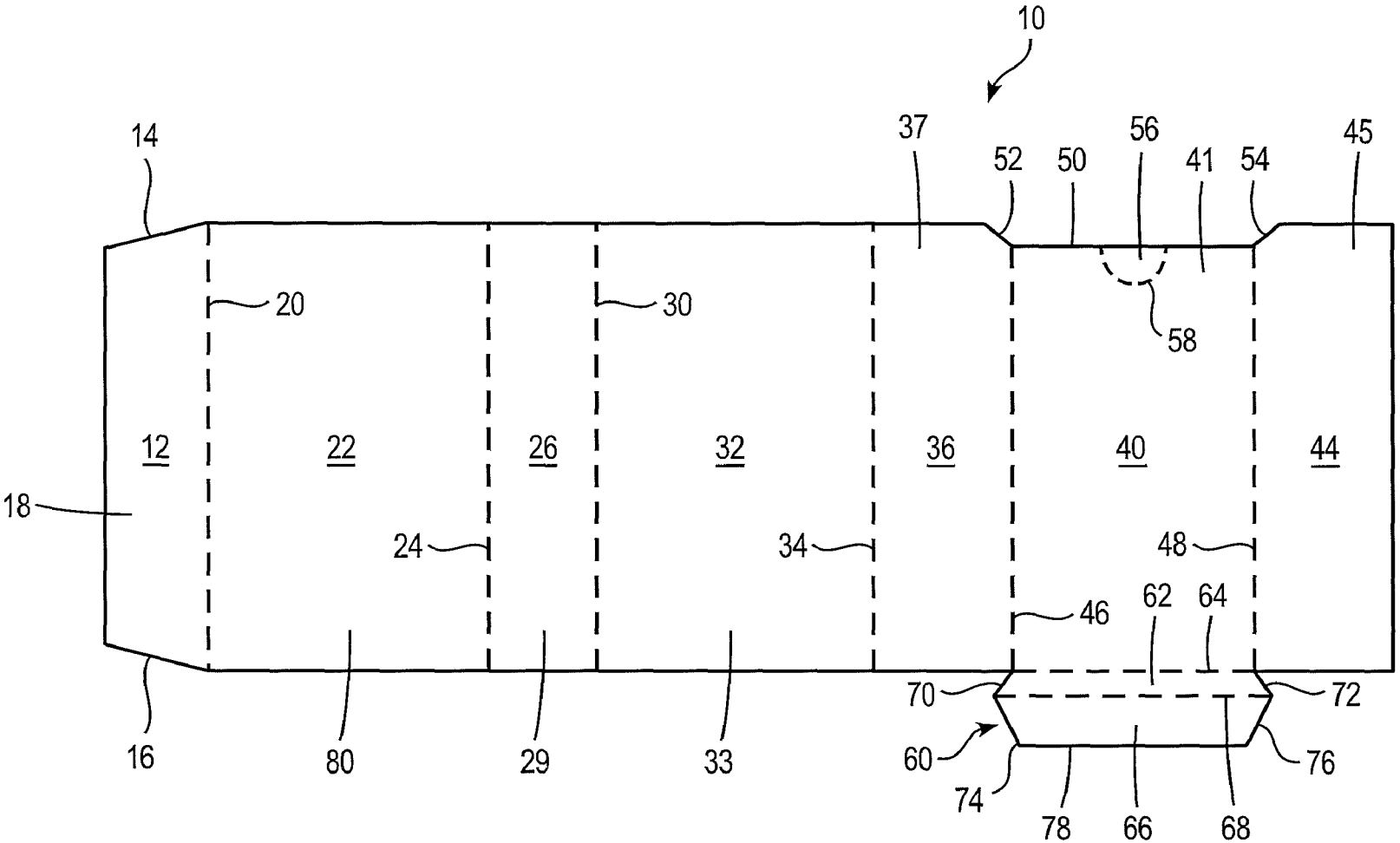
FIG. 1 is a plan view of an embodiment of a blank for forming a sleeve.

FIG. 1 illustrates a blank 10 for forming a sleeve adapted to be placed over a container and contain promotional products, such as packaged tobacco pouched products, in a pocket formed integrally with the sleeve. The container can be, for example, a package such as a soft pack or hinged-lid hard pack containing smoking articles, e.g., traditional cigarettes.

The embodiment of the blank 10 shown in FIG. 1 has a one-piece, elongated configuration and comprises a plurality of panels. The panels are folded to form the sleeve. Beginning at the left end of the illustrated blank 10, the blank 10 includes an inner right side panel 12 having a trapezoidal shape and including an angled upper edge 14 and an angled lower edge 16. The inner right side panel 12 preferably includes an adhesive material applied on at least a portion of the face 18. The upper edge 14 and lower edge 16 extend from a vertical fold line 20 connecting the inner right side panel 12 to a rectangular inner rear panel 22. The inner rear panel 22 is connected along a vertical fold line 24 to a rectangular inner left side panel 26. The inner left side panel 26 preferably includes an adhesive material applied on at least a portion of the face 28. The inner left side panel 26 is connected along a vertical fold line 30 to a rectangular front panel 32 having a face 33. The front panel 32 is connected along a vertical fold line 34 to a rectangular outer right side panel 36 having a face 37. The outer right side panel 36 is connected along a vertical fold line 46 to a rectangular outer rear panel 40 having a face 41. The outer rear panel 40 is connected along a vertical fold line 48 to a rectangular outer left side panel 44 having a face 45.

The fold lines 46, 48 extend upward to a recessed portion 50 of the horizontal top edge of the blank 10 defined by angled edges 52, 54, respectively. An optional semicircular cut out 56 defined by the tear line 58 can be located along recessed portion 50.

As shown in FIG. 1, the blank 10 includes an optional bottom panel 60 disposed below the outer rear panel 40 to form a bottom of the pocket formed between the inner rear panel 22 and outer rear panel 40. The bottom panel 60 includes a stop panel 62 connected to the outer rear panel 40 by a horizontal fold line 64, and a tuck panel 66 below and connected to the stop panel 62 along a horizontal fold line 68. The fold lines 64, 68 are preferably parallel to each other. The stop panel 62 includes angled edges 70, 72, and the tuck panel 66 includes angled edges 74, 76, and a horizontal bottom edge 78.

The blank 10 can be composed of any suitable material. Preferably, the blank is composed of a paper material suitable for forming hinged-lid cigarette boxes. The blank 10 can include one or more layers of the paper material.

In this embodiment, indicia such as logos, informational text, ornamentation or the like can be provided on the front panel 32, outer right side panel 36, outer rear panel 40 and/or the outer left side panel 44. For example, the indicia can be printed on one or more of these panels. Alternatively, the indicia can be provided on a separate sheet adhered to a surface of the blank.

In this embodiment, the vertical fold lines 20, 24, 30, 34, 46 and 48 are preferably parallel to each other, and are preferably perpendicular to the horizontal fold lines 64, 68. When the blank 10 is folded into a sleeve, the front panel 32, outer right side panel 36, outer rear panel 40 and outer left side panel 44 form outer faces of the sleeve. Particularly, the face 33 of the front panel 32 forms the outer front face, the face 45 of the outer left side panel 44 forms the outer left face, the face 37 of the outer right side panel 36 forms the outer right face, and the face 41 of the outer rear panel 40 forms the outer rear face, of the sleeve. The face 28 of the inner left side panel 26 faces and preferably is adhered to an inner face of the outer left side panel 44; the face 18 of the inner right side panel 12 faces and preferably is adhered to an inner face of the outer right side panel 36; and the face 80 of the inner rear panel 22 faces an inner face of the outer rear panel 40 and forms a pocket between the inner rear panel 22 and outer rear panel 40 due to outer right side panel 36 and outer left side panel 44 being wider than the inner right side panel 12 and the inner left side panel 26. The front panel 32 forms an inner front face of the sleeve, the inner left side panel 26 underlies the outer left side panel 44 and forms an inner left face of the sleeve, the inner right side panel 12 underlies the outer right side panel 36 and forms an inner right face of the sleeve, and the inner rear panel 22 underlies the outer rear panel 40 and forms an inner rear face of the sleeve. The inner front face, inner left face, inner right face and inner rear face define the interior of the sleeve configured for snugly receiving a rectangular container such as a cigarette pack. See FIGS. 2 and 3. The tuck panel 66 is tucked between and extends substantially parallel to the inner rear panel 22 and outer rear panel 40, and the stop panel 62 extends perpendicular to opposed vertical faces of the inner rear panel 22 and outer rear panel 40. The stop panel 62 provides two functions in the sleeve. First, the stop panel 62 defines the width of the space between the inner rear panel 22 and outer rear panel 40. The space has a size equal to about the distance between the horizontal fold lines 64, 68. The stop panel 62 also forms a bottom wall of the pocket, which prevents objects contained in the pocket from falling out of the bottom end of the pocket. The tuck panel 66 can be adhesively bonded to the inner rear panel 22.

In the sleeve, the pocket between the opposed faces of the inner rear panel 22 and the outer rear panel 40 extends from the portion 50 of the upper edge of the blank to the fold line 64. The pocket is open at its upper end. The pocket is configured to contain one or more objects. For example, the pocket can be configured to contain one or more packages containing pouches of smokeless tobacco.

The sleeve can be used with various containers having a rectangular longitudinal cross-sectional shape. The containers can be soft packs or hard packs made from cardboard in which cigarettes are stored. Such containers can include a top portion hinged to a bottom portion. Such containers can have an outer cellophane wrapper to retain the freshness of the smoking articles. One of such containers can be inserted into the formed sleeve, such that the sleeve overlies the front face, side faces and rear face of the container. Alternatively, the blank can be placed on the container and folded to form the sleeve. One or more objects, such as promotional products, can then be inserted in the pocket.

Figure 4:
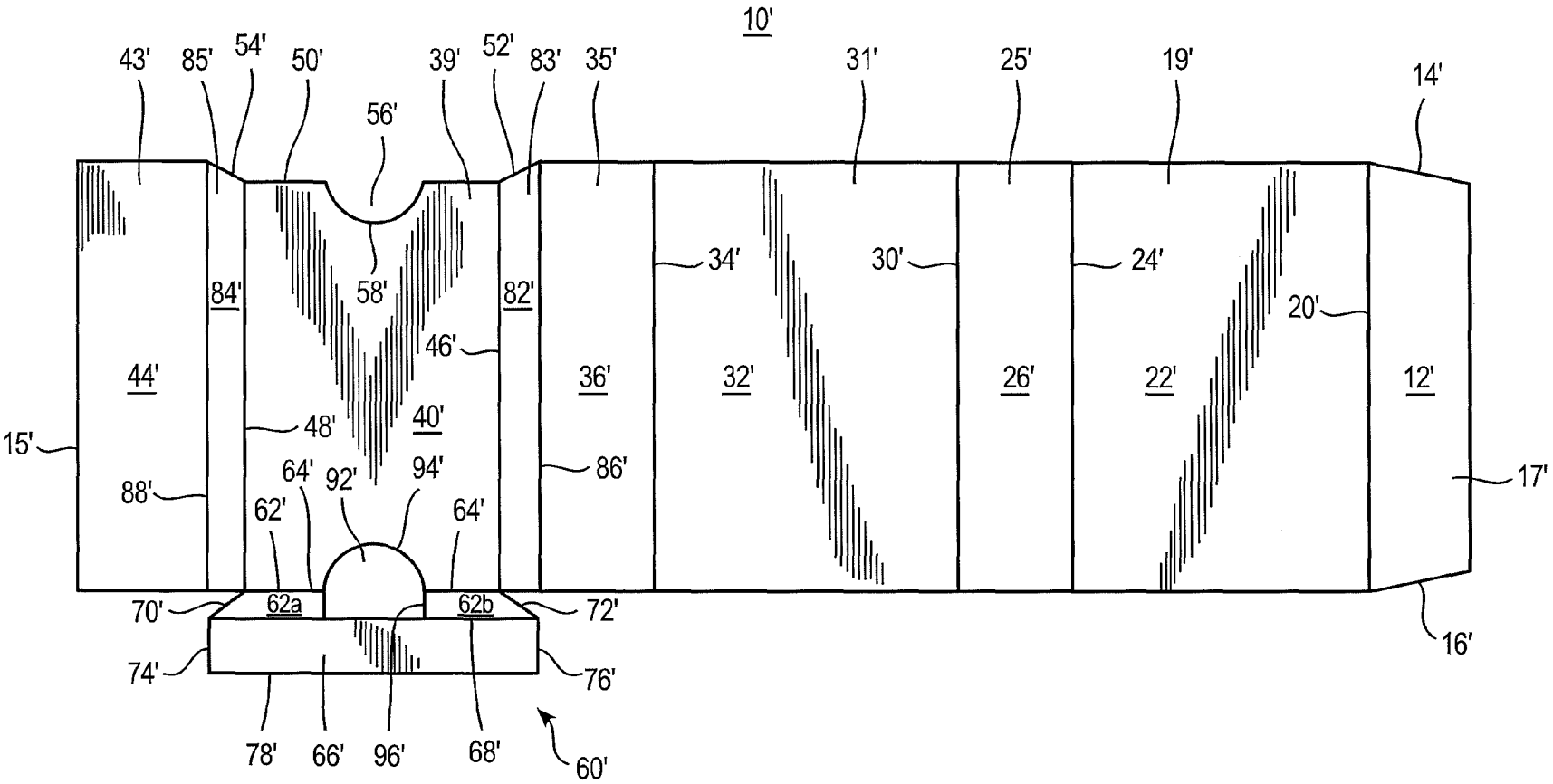
FIG. 4 is a plan view of another embodiment of a blank for forming a sleeve having a pocket formed integrally with the sleeve.

FIG. 4 illustrates another embodiment of a blank 10' for forming a sleeve adapted to be placed over a container and contain promotional products, such as packaged tobacco pouched products, in a pocket formed integrally with the sleeve. The container can be, for example, a package such as a soft pack or hinged-lid hard pack (cigarette pack) containing smoking articles, e.g., traditional cigarettes. The embodiment of the blank 10' shown in FIG. 4 has a one-piece, elongated configuration and comprises a plurality of panels. The panels are folded to form the sleeve.

Beginning at the right end of the illustrated blank 10', the blank 10' includes an inner right side panel 12' having a trapezoidal shape and including an angled upper edge 14' and an angled lower edge 16'. The inner right side panel 12' has an inner face 17' and an outer face on the other side of the panel 12' from the inner face 17'. Preferably, the inner right side panel 12' includes an adhesive material applied on at least a portion of the outer face.

Figure 6:
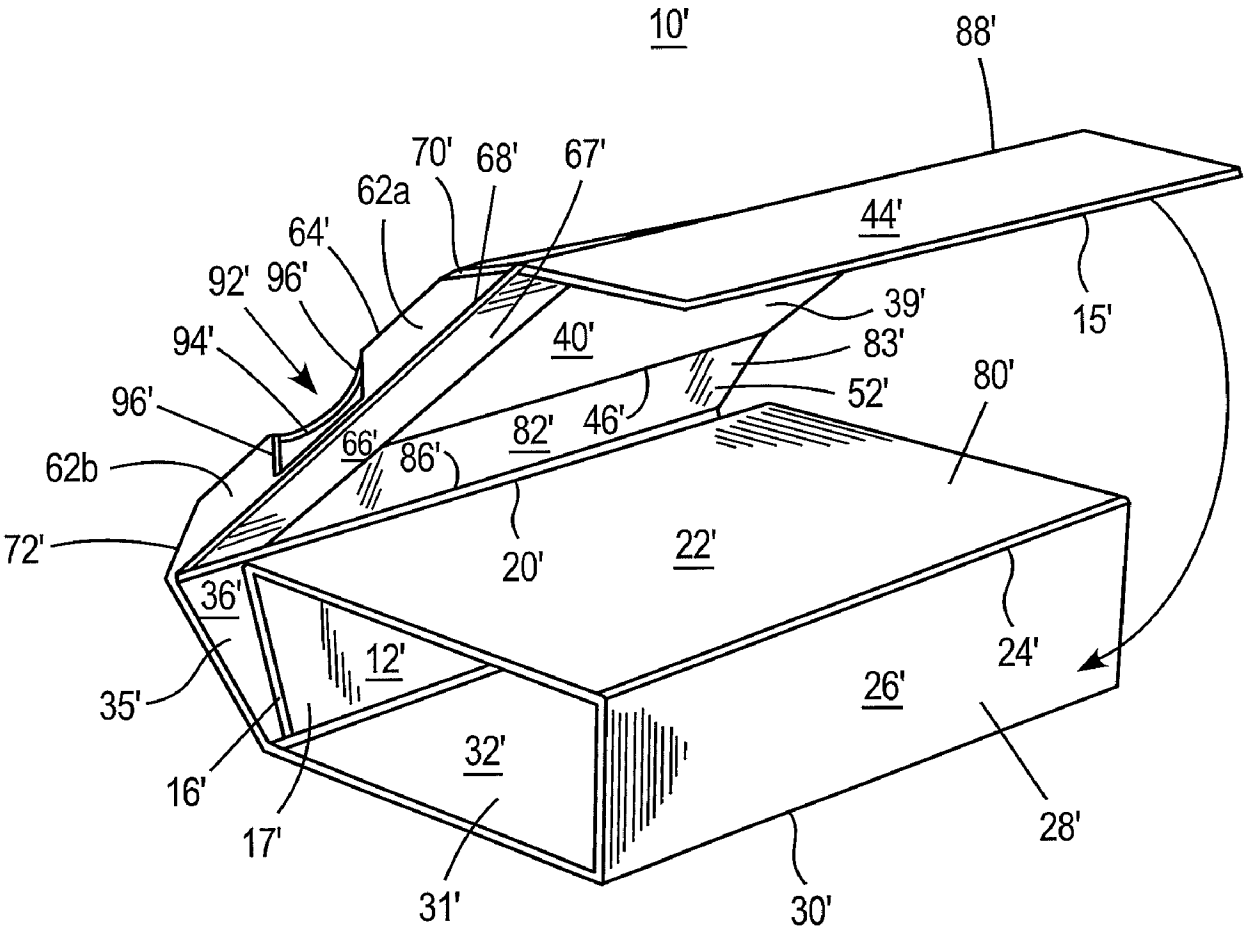
FIG. 6 is another perspective view of the blank shown in FIG. 4 partially folded.

The upper edge 14' and lower edge 16' extend from a vertical fold line 20' connecting the inner right side panel 12' to a rectangular inner rear panel 22'. The inner rear panel 22' is connected along a vertical fold line 24' to a rectangular inner left side panel 26'. The inner left side panel 26' has an inner face 25' and preferably includes an adhesive material applied on at least a portion of an outer face 28' on the other side of the inner left side panel 26' (FIG. 6). The inner left side panel 26' is connected along a vertical fold line 30' to a rectangular front panel 32' having a face 31'. The front panel 32' is connected along a vertical fold line 34' to a rectangular outer right side panel 36' having a face 35'. The outer right side panel 36' is connected along a vertical fold line 86' to a posterior right side panel 82' having a trapezoidal shape and including an angled upper edge 52' and a face 83'. The posterior right side panel 82' is connected along a vertical fold line 46' to a rectangular outer rear panel 40' having a face 39'. The outer rear panel 40' is connected along a vertical fold line 48' to a posterior left side panel 84' having a trapezoidal shape and including an angled upper edge 54' and a face 85'. The posterior left side panel 84' is connected along a vertical fold line 88' to a rectangular outer left side panel 44' having a face 43'. Preferably, the outer left side panel 44' includes adhesive material applied on at least a portion of the inner face 43'.

The fold lines 46', 48' extend upward to a recessed portion 50' of the horizontal top edge of the blank 10' defined by angled edges 52', 54', respectively. Preferably, a semicircular cut out 56' defined by the edge 58' is located along recessed portion 50'.

As shown in FIG. 4, the blank 10' preferably includes a bottom panel 60' disposed below the outer rear panel 40' to form a bottom of the pocket formed between the inner rear panel 22' and outer rear panel 40'. The bottom panel 60' includes a stop panel 62' connected to the outer rear panel 40' by a horizontal fold line 64', and a tuck panel 66' below and connected to the stop panel 62' along a horizontal fold line 68'. The tuck panel 66' includes a face 67' (FIG. 6) and preferably includes an adhesive material applied on at least a portion of the face 67'. The fold lines 64', 68' are preferably parallel to each other. The stop panel 62' includes angled edges 70', 72', and the tuck panel 66' includes edges 74', 76', and a horizontal bottom edge 78'.

Preferably, a semicircular edge 94' located along the bottom of the outer rear panel 40' has straight extensions 96' which extend from the first horizontal fold line 64' across the stop panel 62' to the second horizontal fold line 68' forming an opening 92'. The straight extensions 96' of the opening 92' separate the stop panel 62' into two spaced apart portions **62*a* and 62*b***.

The blank 10' can be composed of any suitable material. Preferably, the blank is composed of a paper material suitable for forming hinged-lid cigarette boxes. The blank 10' can include one or more layers of the paper material.

In this embodiment, indicia such as logos, informational text, ornamentation or the like can be provided on the front panel 32', outer right side panel 36', outer rear panel 40' and/or the outer left side panel 44'. For example, the indicia can be printed on one or more of these panels. Alternatively, the indicia can be provided on a separate sheet adhered to a surface of the blank 10'.

Figure 5:
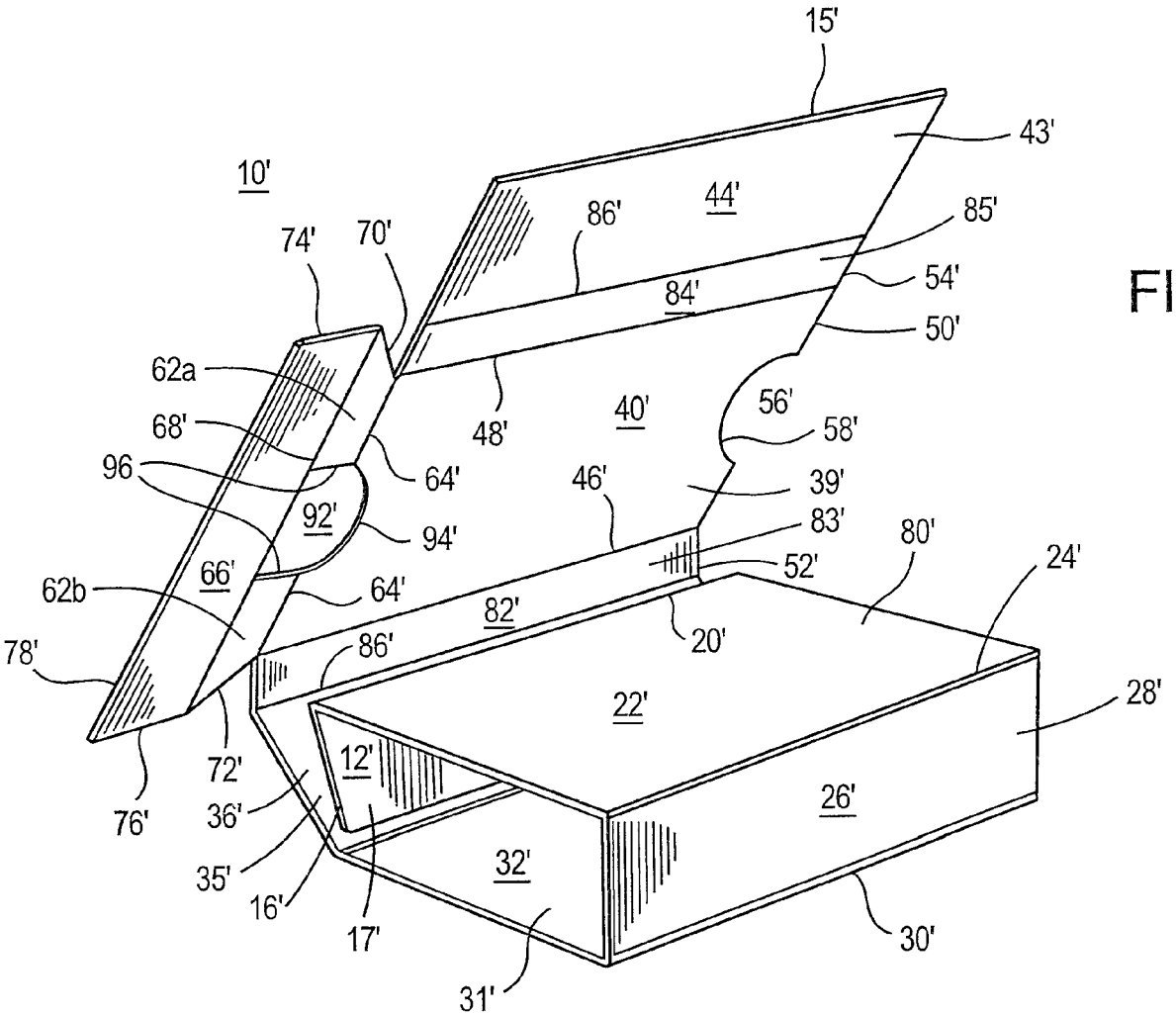
FIG. 5 is a perspective view of the blank shown in FIG. 4 partially folded.
Figure 8:
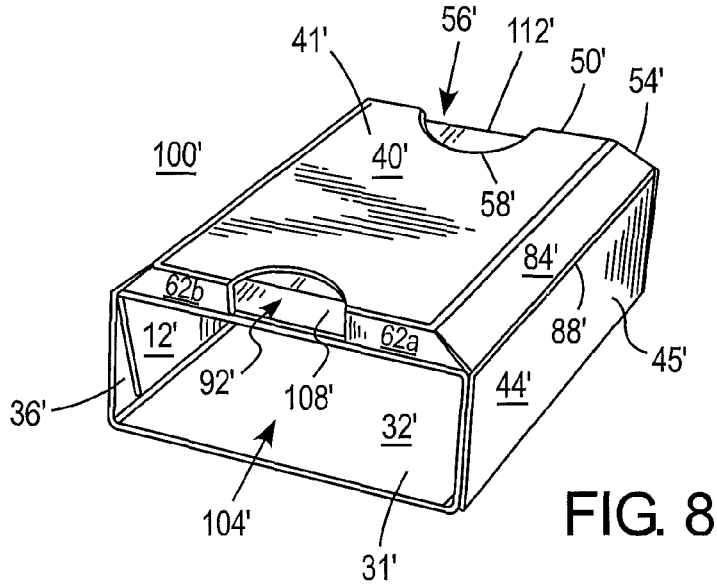
FIG. 8 is a perspective view of the sleeve having a pocket formed integrally with the sleeve formed by folding the blank shown in FIG. 4 and an embodiment of an insert in the pocket.

In this embodiment, the vertical fold lines 20', 24', 30', 34', 86', 46', 48' and 88' are preferably parallel to each other, and are preferably perpendicular to the horizontal fold lines 64', 68'. Referring to FIG. 5, when the blank 10' is folded into a sleeve 100' having a recess 104' and a pocket 108' (FIG. 8), the front panel 32', outer right side panel 36', posterior right side panel 82', outer rear panel 40', posterior left side panel 84' and outer left side panel 44' form outer faces of the sleeve 100'.

In particular, the inner right side panel 12' is folded to underlie the outer right side panel 36'. The portions of the stop panel **62*a*, 62*b* are folded inward about horizontal fold line 64' to form the bottom of the pocket 108'. The tuck panel 66' is folded about horizontal fold line 68' (FIG. 6) and preferably, adhesive material on face 67' bonds the tuck panel 66' to the outer face 80' of the inner rear panel 22'. Preferably, the adhesive material of the inner right side panel 12' bonds the inner face 35' of the outer right side panel 36' to the inner right side panel 12' with the vertical fold line 86' overlying the vertical fold line 20'. The outer left side panel 44' is folded to overlie the inner left side panel 26'. Preferably the adhesive material on the inner face 43' of the outer left side panel 44' bonds the outer left side panel 44' to the inner left side panel 26'. Preferably, vertical fold line 86' overlies vertical fold line 24' and left side edge 15' of the outer left side panel 44' is proximate and parallel to vertical fold line 30'**.

An outer face 80' of the inner rear panel 22' faces an inner face 39' of the outer rear panel 40' and forms a pocket 108' between the inner rear panel 22' and outer rear panel 40' having sides formed by posterior right side panel 82' and posterior left side panel 84'. Preferably, the outer rear panel 40' is narrower than the inner rear panel 22' such that the posterior right side panel 82' and posterior left side panel 84' form beveled sidewalls of the pocket 108'. Preferably, the lower edges of the posterior side panels 82', 84' substantially meet the angled edges 70', 72' of the folded stop panel 62'.

The front panel 32' forms an inner front face 31' of the sleeve 100', the inner left side panel 26' underlies the outer left side panel 44' and forms an inner left face 25' of the sleeve 100', the inner right side panel 12' underlies the outer right side panel 36' and forms an inner right face 17' of the sleeve 100', and the inner rear panel 22' underlies the outer rear panel 40' and forms an inner rear face 19' of the sleeve 100'. The inner front face 31', inner left face 25', inner right face 17' and inner rear face 19' define the interior (recess 104') of the sleeve 100' configured for snugly receiving a rectangular container such as a cigarette pack. The tuck panel 66' is tucked between and extends substantially parallel to the inner rear panel 22' and outer rear panel 40', and the stop panel 62' (portions 62*a*, 62*b*) extends perpendicular to opposed vertical faces of the inner rear panel 22' and outer rear panel 40'. The stop panel 62' provides two functions in the sleeve. First, the stop panel 62' defines the width of the space between the inner rear panel 22' and outer rear panel 40'. The space has a size equal to about the distance between the horizontal fold lines 64', 68'. The stop panel 62' also forms a bottom wall of the pocket, which prevents objects contained in the pocket from falling out of the bottom end of the pocket. The tuck panel 66' can be adhesively bonded to the inner rear panel 22'.

Figure 7:
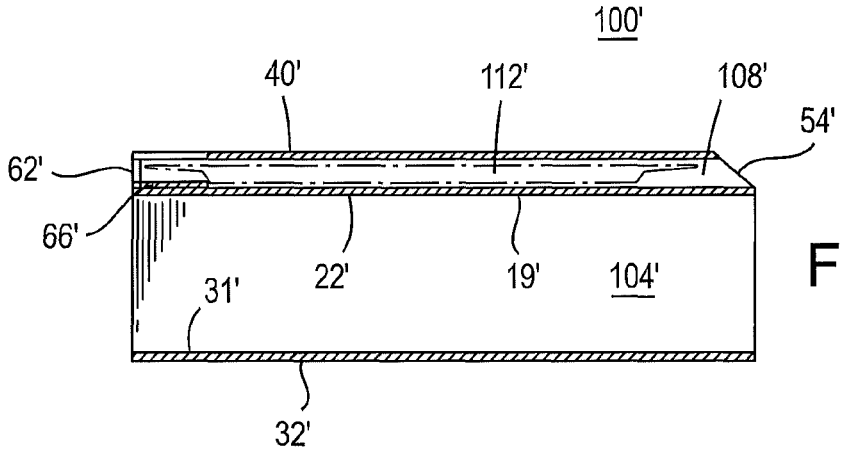
FIG. 7 is a cross sectional view through a sleeve having a pocket formed integrally with the sleeve formed by folding the blank shown in FIG. 4 and an embodiment of an insert in the pocket.

In the sleeve 100', the pocket 108' between the opposed faces of the inner rear panel 22' and the outer rear panel 40' extends from the portion 50' of the upper edge of the blank to the fold line 64'. The pocket 108' is open at its upper end. The pocket 108' is configured to contain one or more objects 112' (FIG. 7). For example, the pocket 108' can be configured to contain one or more packages 112' containing pouches of smokeless tobacco.

The semicircular opening 56' at the upper end of the pocket 108' and the opening 92' at the lower end of the pocket 108' function as access openings. An object 112' disposed in the pocket 108' can be removed by a user (consumer) by pushing with a finger, thumb, or the like against an end of the object 112' exposed through the lower opening 92' and/or by pulling another end of the object 112' exposed through the upper opening 56'.

Figure 9:
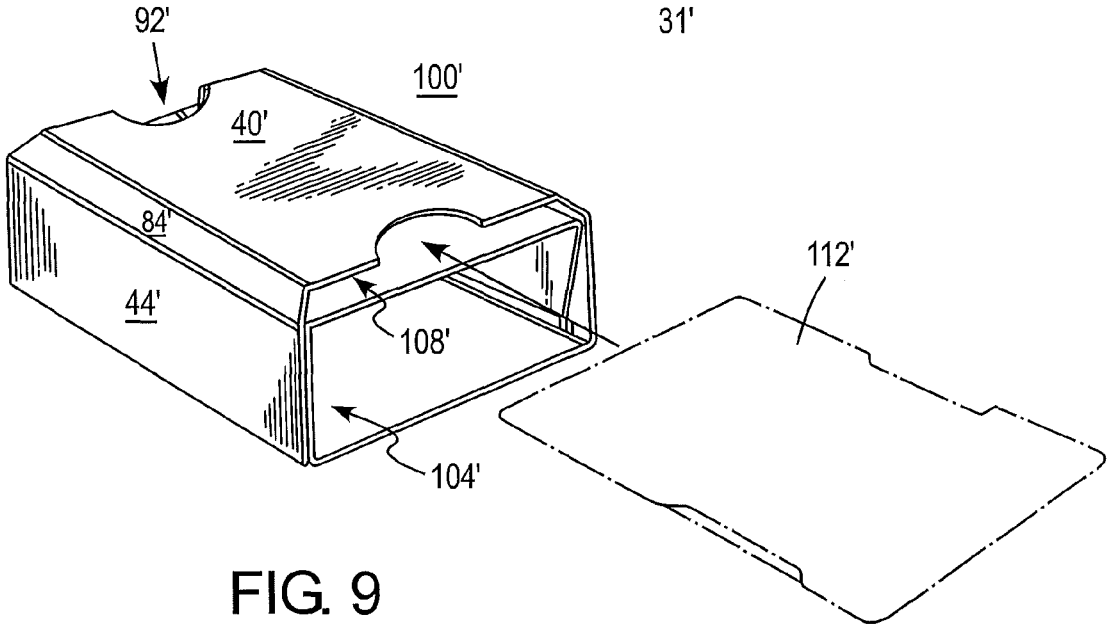
FIG. 9 is another perspective view of the sleeve, pocket and insert shown in FIG. 8.

The sleeve 100' can be used with various containers having a rectangular longitudinal cross-sectional shape. The containers can be soft packs or hard packs made from cardboard in which cigarettes are stored. Such containers can include a top portion hinged to a bottom portion. Such containers can have an outer cellophane wrapper to retain the freshness of the smoking articles. One of such containers can be inserted into the recess 104' of the formed sleeve 100', such that the sleeve 100' overlies the front face, side faces and rear face of the container. Alternatively, the blank 10' can be placed on the container and folded to form the sleeve 100'. One or more objects 112', such as promotional products, can then be inserted in the pocket 108' (FIG. 9).

While the invention has been described in detail with reference to specific embodiments thereof, it will be apparent to those skilled in the art that various changes and modifications can be made, and equivalents employed, without departing from the scope of the appended claims.

The invention claimed is:

1. An elongate blank for forming a sleeve for a container, comprising:

an inner right side panel;

an inner rear panel connected along a first vertical fold line to the inner right side panel;

an inner left side panel connected to the inner rear panel by a second vertical fold line;

a front panel connected to the inner left side panel by a third vertical fold line;

an outer right side panel connected to the front panel by a fourth vertical fold line;

an outer rear panel connected to the outer right side panel by a fifth vertical fold line;

an outer left side panel connected to the outer rear panel by a sixth vertical fold line;

a bottom panel having a stop panel disposed below and connected to the outer rear panel by a first horizontal fold line and a tuck panel disposed below and connected to the stop panel along a second horizontal fold line;

wherein the inner rear panel has a top edge and a bottom edge, the top and bottom edges extending from the first vertical fold line to the second vertical fold line, the top and bottom edges also being end edges of the blank;

wherein the front panel has a top edge and a bottom edge, the top and bottom edges extending from the third vertical fold line to the fourth vertical fold line, the top and bottom edges also being end edges of the blank;

wherein the elongate blank is foldable to form a sleeve opening between the inner right side panel forming a first side of the sleeve, the inner rear panel forming the rear of the sleeve, the inner left side panel forming a second side of the sleeve opposing said first side and the front panel forming the front of the sleeve and opposing said inner rear panel and a pocket between the inner rear panel and the outer rear panel, wherein the sleeve is open at opposite ends, and wherein the pocket is open at least at one end; and wherein the outer rear panel and the stop panel include a cut-out located at a lower end of the outer rear panel and which extends from the first horizontal fold line across the stop panel to the second horizontal fold line.

2. The blank of claim 1, wherein the outer rear panel includes a semicircular cut-out located at an upper end of the outer rear panel.

3. The blank of claim 1, wherein the inner right side panel is trapezoidal shaped; and the inner rear panel, inner left side panel, front panel, outer right side panel, outer rear panel and outer left side panel are rectangular shaped.

4. The blank of claim 1, wherein the stop panel has angled side edges connecting the first horizontal fold line to the second horizontal fold line, and the tuck panel has a horizontal bottom edge and angled side edges connecting the second horizontal fold line to the horizontal bottom edge.

5. The blank of claim 1, wherein the first, second, third, fourth, fifth and sixth vertical fold lines are parallel to each other.

6. The blank of claim 4, wherein:

the first, second, third, fourth, fifth and sixth vertical fold lines are parallel to each other; and the first and second horizontal folds lines are parallel to each other and perpendicular to the first, second, third, fourth, fifth and sixth vertical fold lines.

7. The blank of claim 1, wherein an adhesive material is provided on at least a portion of a face of each of the inner right side panel and the inner left side panel.

8. The blank of claim 1, wherein the outer right side panel and outer left side panel are wider than the inner right side panel and the inner left side panel, respectively.

9. A sleeve formed from a folded blank according to claim 1, wherein:

the front panel forms an outer front face and an inner front face of the sleeve;

the outer left side panel forms an outer left face of the sleeve;

the outer right side panel forms an outer right face of the sleeve;

the outer rear panel forms an outer rear face of the sleeve;

the inner left side panel underlies the outer left side panel and forms an inner left face of the sleeve;

the inner right side panel underlies the outer right side panel and forms an inner right face of the sleeve;

the inner rear panel underlies the outer rear panel and forms an inner rear face of the sleeve;

the inner front face, inner left face, inner right face and inner rear face define the interior of the sleeve such that the inner front face is separated from the inner rear face by an open space sized to slidingly receive a cigarette pack; and the inner rear panel and outer rear panel define the pocket therebetween such that the inner rear panel is separated from the outer rear panel by an open space forming the pocket sized to receive promotional smokeless tobacco packaging.

10. The sleeve of claim 9, wherein:

the inner left side panel is adhesively bonded to the outer left side panel; and the inner right side panel is adhesively bonded to the outer right side panel.

11. A sleeve formed from a folded blank according to claim 1, wherein:

the front panel forms an outer front face and an inner front face of the sleeve;

the outer left side panel forms an outer left face of the sleeve;

the outer right side panel forms an outer right face of the sleeve;

the outer rear panel forms an outer rear face of the sleeve;

the inner left side panel underlies the outer left side panel and forms an inner left face of the sleeve;

the inner right side panel underlies the outer right side panel and forms an inner right face of the sleeve;

the inner rear panel underlies the outer rear panel and forms an inner rear face of the sleeve;

the inner front face, inner left face, inner right face and inner rear face define the interior of the sleeve such that the inner front face is separated from the inner rear face by an open space sized to slidingly receive a container; and the inner rear panel and outer rear panel define the pocket therebetween.

12. A packaged article comprising:

a container having a rectangular cross-section and including a front face, a left face, a right face and a rear face; and a sleeve according to claim 11 surrounding the container such that the front panel overlies the front face of the container, the inner and outer left side panels overlie the left face of the container, the inner and outer right side panels overlie the right face of the container, and the inner and outer rear panels overlie the rear face of the container.

13. The packaged article of claim 12, wherein the container is a hard or soft cigarette pack.

14. A method of forming a sleeve from the blank according to claim 1, comprising:

folding the blank such that:

the front panel forms an outer front face and an inner front face of the sleeve;

the outer left side panel forms an outer left face of the sleeve;

the outer right side panel forms an outer right face of the sleeve;

the outer rear panel forms an outer rear face of the sleeve;

the inner left side panel underlies the outer left side panel and forms an inner left face of the sleeve;

the inner right side panel underlies the outer right side panel and forms an inner right face of the sleeve;

the inner rear panel underlies the outer rear panel and forms an inner rear face of the sleeve;

the inner front face, inner left face, inner right face and inner rear face define the interior of the sleeve such that the inner front face is separated from the inner rear face by an open space sized to slidingly receive a cigarette pack; and the inner rear panel and the outer rear panel define the pocket between them such that the inner rear panel is separated from the outer rear panel by an open space forming the pocket sized to receive promotional smokeless tobacco packaging.

15. The method of claim 14, further comprising placing the sleeve on a container.

16. The method of claim 15, wherein the container is a hard or soft cigarette pack.

17. The method of claim 14, further comprising:

adhesively bonding the inner left side panel to the outer left side panel; and adhesively bonding the inner right side panel to the outer right side panel.

18. The method of claim 14, further comprising placing a promotional package in the pocket between the inner and outer rear panels.

19. The method of claim 18, wherein the promotional package is a thin rectangular package containing one or more smokeless tobacco pouches therein.

20. The method of claim 14, wherein:

the blank further comprises:

wherein the stop panel has angled side edges connecting the first horizontal fold line to the second horizontal fold line, and the tuck panel has a horizontal bottom edge and angled side edges connecting the second horizontal fold line to the horizontal bottom edge; and the method further comprises:

folding the stop panel about the first horizontal fold line between the bottom panel and the outer rear panel so as to form the pocket between the inner rear panel and the outer rear panel; and folding the tuck panel about the second horizontal fold line between the stop panel and the tuck panel, and adhesively bonding the tuck panel to the inner rear panel.

21. The blank of claim 1, wherein the cut-out includes a semicircular cut-out located at the lower end of the outer rear panel and straight extensions, which extend from the first horizontal fold line across the stop panel to the second horizontal fold line.

22. The blank of claim 1, wherein the outer rear panel is narrower than the inner rear panel.

23. The blank of claim 22, further comprising:

a posterior right side panel connected to the outer right side panel by a seventh vertical fold line and connected to the outer rear panel by the fifth vertical fold line;

a posterior left side panel connected to the outer rear panel by the sixth vertical fold line and connected to the outer left side panel by an eighth vertical fold line;

wherein the elongate blank is foldable to form a sleeve opening between the inner right side panel, the inner rear panel, the inner left side panel and the front panel and the pocket is formed between the inner rear panel, the posterior right side panel, the outer rear panel and the posterior left side panel, such that the posterior right side panel and posterior left side panel form beveled sidewalls of the pocket.

24. The method of claim 20, wherein:

the blank further comprises:

a semicircular cut-out located at an upper end of the outer rear panel;

a posterior right side panel connected to the outer right side panel by a seventh vertical fold line and connected to the outer rear panel by the fifth vertical fold line;

a posterior left side panel connected to the outer rear panel by the sixth vertical fold line and connected to the outer left side panel by an eighth vertical fold line; and the method further comprises:

folding the blank such that:

the inner rear panel, the posterior right side panel, the outer rear panel and the posterior left side panel define the pocket there between.

25. A sleeve formed from a folded blank according to claim 4, wherein:

the front panel forms an outer front face and an inner front face of the sleeve;

the outer left side panel forms an outer left face of the sleeve;

the outer right side panel forms an outer right face of the sleeve;

the outer rear panel forms an outer rear face of the sleeve;

the inner left side panel underlies the outer left side panel and forms an inner left face of the sleeve;

the inner right side panel underlies the outer right side panel and forms an inner right face of the sleeve;

the inner rear panel underlies the outer rear panel and forms an inner rear face of the sleeve;

the inner front face, inner left face, inner right face and inner rear face define the interior of the sleeve such that the inner front face is separated from the inner rear face by an open space sized to slidingly receive a container; and the inner rear panel, the stop panel and outer rear panel define the pocket therebetween, the tuck panel being adhesively bonded to the inner rear panel.

26. An elongate blank for forming a sleeve for a container, comprising:

an inner right side panel;

an inner rear panel connected along a first vertical fold line to the inner right side panel;

an inner left side panel connected to the inner rear panel by a second vertical fold line;

a front panel connected to the inner left side panel by a third vertical fold line;

an outer right side panel connected to the front panel by a fourth vertical fold line;

an outer rear panel connected to the outer right side panel by a fifth vertical fold line;

an outer left side panel connected to the outer rear panel by a sixth vertical fold line;

wherein the inner rear panel has a top edge and a bottom edge, the top and bottom edges extending from the first vertical fold line to the second vertical fold line, the top and bottom edges also being end edges of the blank;

wherein the front panel has a top edge and a bottom edge, the top and bottom edges extending from the third vertical fold line to the fourth vertical fold line, the top and bottom edges also being end edges of the blank;

wherein the elongate blank is foldable to form a sleeve opening between the inner right side panel forming a first side of the sleeve, the inner rear panel forming the rear of the sleeve, the inner left side panel forming a second side of the sleeve opposing said first side and the front panel forming the front of the sleeve and opposing said inner rear panel and a pocket between the inner rear panel and the outer rear panel, wherein the sleeve is open at opposite ends, and wherein the pocket is open at least at one end;

further comprising a bottom panel including a trapezoidal stop panel disposed below and connected to the outer rear panel by a first horizontal fold line; and a tuck panel disposed below and connected to the stop panel along a second horizontal fold line, wherein the stop panel has angled side edges connecting the first horizontal fold line to the second horizontal fold line, and the tuck panel has a horizontal bottom edge and side edges connecting the second horizontal fold line to the horizontal bottom edge; and wherein the outer rear panel and the stop panel include a cut-out located at a lower end of the outer rear panel and which extends from the first horizontal fold line across the stop panel to the second horizontal fold line.

27. The blank of claim 1, wherein the cut-out separates the stop panel into two spaced apart portions.

28. The blank of claim 26, wherein the cut-out separates the stop panel into two spaced apart portions.

* * * * *